US006655387B2

(12) United States Patent
Leslie

(10) Patent No.: US 6,655,387 B2
(45) Date of Patent: Dec. 2, 2003

(54) TOWEL FOR HAIR STYLING

(75) Inventor: David Leslie, Gilbert, AZ (US)

(73) Assignee: 90 Degree Towel, LLC, Phoenix, AZ (US)

( * ) Notice: Subject to any disclaimer, the term of this patent is extended or adjusted under 35 U.S.C. 154(b) by 246 days.

(21) Appl. No.: 09/829,579

(22) Filed: Apr. 10, 2001

(65) Prior Publication Data

US 2002/0144701 A1 Oct. 10, 2002

(51) Int. Cl.[7] ..... A45D 7/04; A45D 44/00
(52) U.S. Cl. ..... 132/207; 132/333
(58) Field of Search ..... 132/212, 333, 132/202, 208, 207; 2/46, 50, 60, 48, 108, 6, 468, 91, 98

(56) References Cited

U.S. PATENT DOCUMENTS 1,793,243 A * 2/1931 Peterson et al. ..... 2/50
2,984,840 A * 5/1961 Parco ..... 2/46
4,416,025 A * 11/1983 Moret et al. ..... 2/49
4,543,668 A * 10/1985 Franklin ..... 2/48
5,259,068 A * 11/1993 Carroll ..... 2/104
5,459,877 A * 10/1995 Roberti ..... 2/104
5,956,761 A * 9/1999 Capnerhurst ..... 2/46

* cited by examiner

*Primary Examiner*—John J. Wilson
*Assistant Examiner*—Robyn Kien Doan
(74) *Attorney, Agent, or Firm*—Marvin H. Kleinberg; Kleinberg & Lerner, LLP

(57) ABSTRACT

An improved towel has at least a top edge and first and second side edges, and contains an improvement, which includes a slit cut into the towel, the slit extends partially into the towel from the top edge and is disposed substantially parallel to the side edges, the towel further includes a reinforcement means located on the towel substantially adjacent to an end point of the slit, and an attachment means coupled to two corners of the towel.

7 Claims, 2 Drawing Sheets

TOWEL FOR HAIR STYLING

BACKGROUND OF THE INVENTION

1. Field of the Invention

The present invention relates to the field of towels, and more particularly to an improved towel that is intended to be used in a hair salon or within the hair care, cosmetology, spa and other related industries and services.

2. Prior Art

The present invention is primarily intended to be used within the cosmetology, beauty and hair care industries. Whenever a client visits a hair salon for a haircut or other related salon services, it is customary to for the salon to provide a towel that covers the person's neck and shoulders. The purpose of the towel is to provide protection to the client's clothing and skin from any hair clippings, water or chemicals that may be used. This protection is increasingly more important, given the ever more prevalent use of special colorings, dyes and other materials in the beauty and hair care industry. Similarly, in the cosmetics and cosmetology fields it is often desired to provide a protective covering for the customer who is applying beauty products.

In the past, it has been the usual practice to use an ordinary, rectangular, towel to provide the client with the needed protection. This approach has not been entirely satisfactory, however. A rectangular towel is not necessarily well suited to fit comfortably around a person's neck. The towel will not drape smoothly over the person's shoulders and will typically bunch up to form wrinkles and voids. The towel will not have a continuous fall from the shoulder. This is undesirable for a number of reasons. First, the presence of the wrinkles and voids results in an unkempt and unprofessional appearance. This is often unacceptable to the hair and beauty salon. In addition, the voids and open spaces can allow the hair clippings, chemicals and other items to fall beneath the towel. Then, the protection which the towel is sought to provide is obviated. Also, bunching around the neck limits the application of styling chemicals and other grooming techniques.

It has been known in the past to use special smocks or aprons which can take the place of the usual towel. These alternative items each have their own drawbacks and limitations, however. The specialized smocks and aprons are often bigger and more cumbersome than a towel. Perhaps most important, these items are significantly more expensive to manufacture, leading to higher prices for the salon. Being larger, the towels are also more expensive to launder, thereby adding to the business expenses of the salon.

SUMMARY OF THE PRESENT INVENTION

The present invention provides an improved towel that is intended and designed to overcome the limitations of the prior art. The towel is intended to be used primarily in the cosmetology, beauty and hair care industries. In its preferred embodiment, the present invention provides a towel which has at least a top edge and first and second side edges, and contains an improvement, which includes a slit cut into the towel, the slit extends partially into the towel from the top edge and is disposed substantially parallel to the side edges, the towel further includes a reinforcement means located on the towel substantially adjacent to an end point of the slit, and an attachment means coupled to two corners of the towel.

DETAILED DESCRIPTION OF THE PREFERRED EMBODIMENT

An improved towel will be described. In the following description, for the purposes of explanation, specific construction details, arrangements, and materials are set forth in order to provide a more thorough understanding of the present invention. It will be apparent to those skilled in the art, however, that the present invention may be practiced without these specific details. In other instances, well known manufacturing methods and structures have not been described in detail so as not to obscure the present invention unnecessarily.

Figure 1:
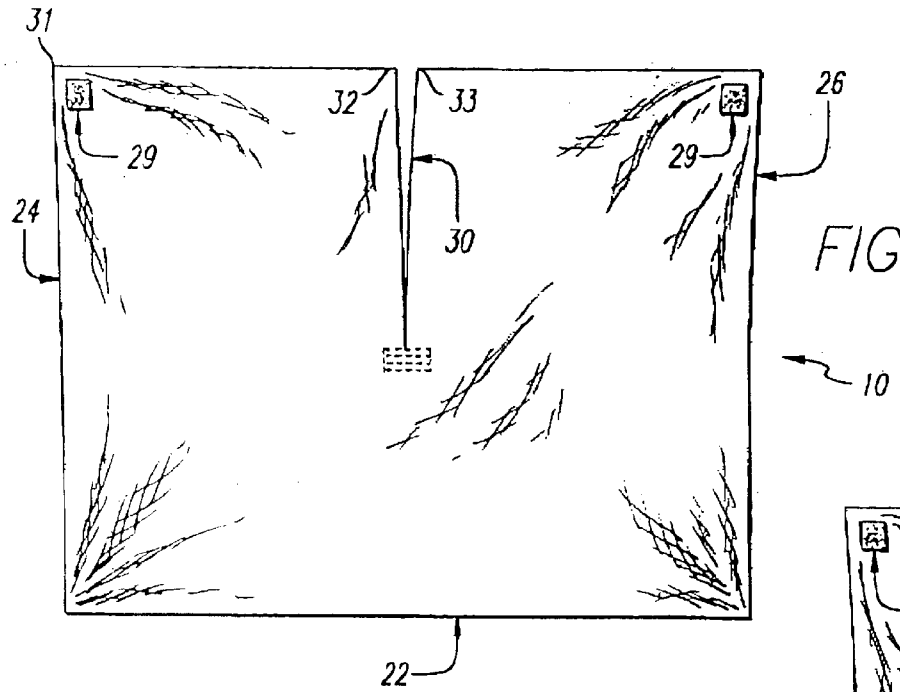
FIG. 1 is a top plan view of the preferred embodiment of the present invention.

Referring first to FIG. 1, a top plan view of the preferred embodiment of the improved towel 10 is shown. The towel is approximately rectangular in shape. The towel of the present invention is generally of the size of towels that are used in the beauty and hair care industry. A common size for such towels is approximately 17 by 23 inches. It will be apparent to those skilled in the art, however, that the exact dimensions of the towel 10 may vary from these amounts without departing from the overall spirit and scope of the present invention.

The towel is manufactured from any suitable material. By way of example, the towel can be manufactured from cotton. Cotton is a common and widely accepted material for towels that are used within the hair care industry. Other fabrics or materials can also be used for the towel. These other fabrics include natural materials such as wool, or synthetics such as polyester or rayon. The towel is manufactured to have a sheet-like or web construction. An alternative embodiment of the towel is manufactured from paper. The paper may be coated or impregnated with a material to make it water-resistant. It will be apparent to those skilled in the art that the exact material chosen will vary according to the design choice of the user, and the specific application in which the towel is used.

Referring again to FIG. 1, the towel 10 is seen to have a top edge 20, a bottom edge 22 and two side edges 24 and 26. A slit 30 is cut into the towel. The slit 30 extends downward from the top edge 20. It is disposed substantially parallel to the side edges 24 and 26. The slit 30 does not extend all of the way through the towel 10. It instead stops at a point that is part way through the towel. It has been found that in the preferred embodiment, the slit should extend approximately one-third to one-half of the distance between the top and bottom edges.

A reinforcement 28 is placed on the towel where the slit 30 ends. In the preferred embodiment, the reinforcement 28 is made from heavy stitching. The reinforcement will prevent the towel from ripping or tearing, and keep the slit 30 from extending further than intended into the towel. Other means of reinforcing the towel can also be used with similar effectiveness.

The towel, being rectangular in shape, will normally have four corners. Referring again to FIG. 1, the two corners on the upper edge 20 of the towel 10 are referred to by reference numerals 31 and 34. The addition of the slit 30 creates two additional corners that are referred to by reference numerals 32 and 33.

The preferred embodiment of the towel 10 includes a closure means 29 that is attached to the towel near corners 31 and 34. The closure means 29 allows the towel to be fixed around the neck and shoulders of a user, and its operation is described in more detail with respect to FIG. 2 below. The closure means 29 is illustrated schematically in FIG. 1.

The exact structure of the closure means 29 may take a variety of forms. In the preferred embodiment, the closure means 29 is a simple button and buttonhole. It will be apparent to those skilled in the art, however, that the closure means may take many alternative embodiments. In one alternative embodiment, the closure means may be cloth material, such as VELCRO®, that sticks to another cloth material. In a second alternative embodiment, the closure may be strings or laces that can be tied together. In yet another alternative embodiment, the closure may be a button or snap. It will also be apparent to those skilled in the art that the closure means may also be omitted from the towel, and that the towel can be placed loosely around the user's shoulders when in use, and not fixed in place.

Figure 2:
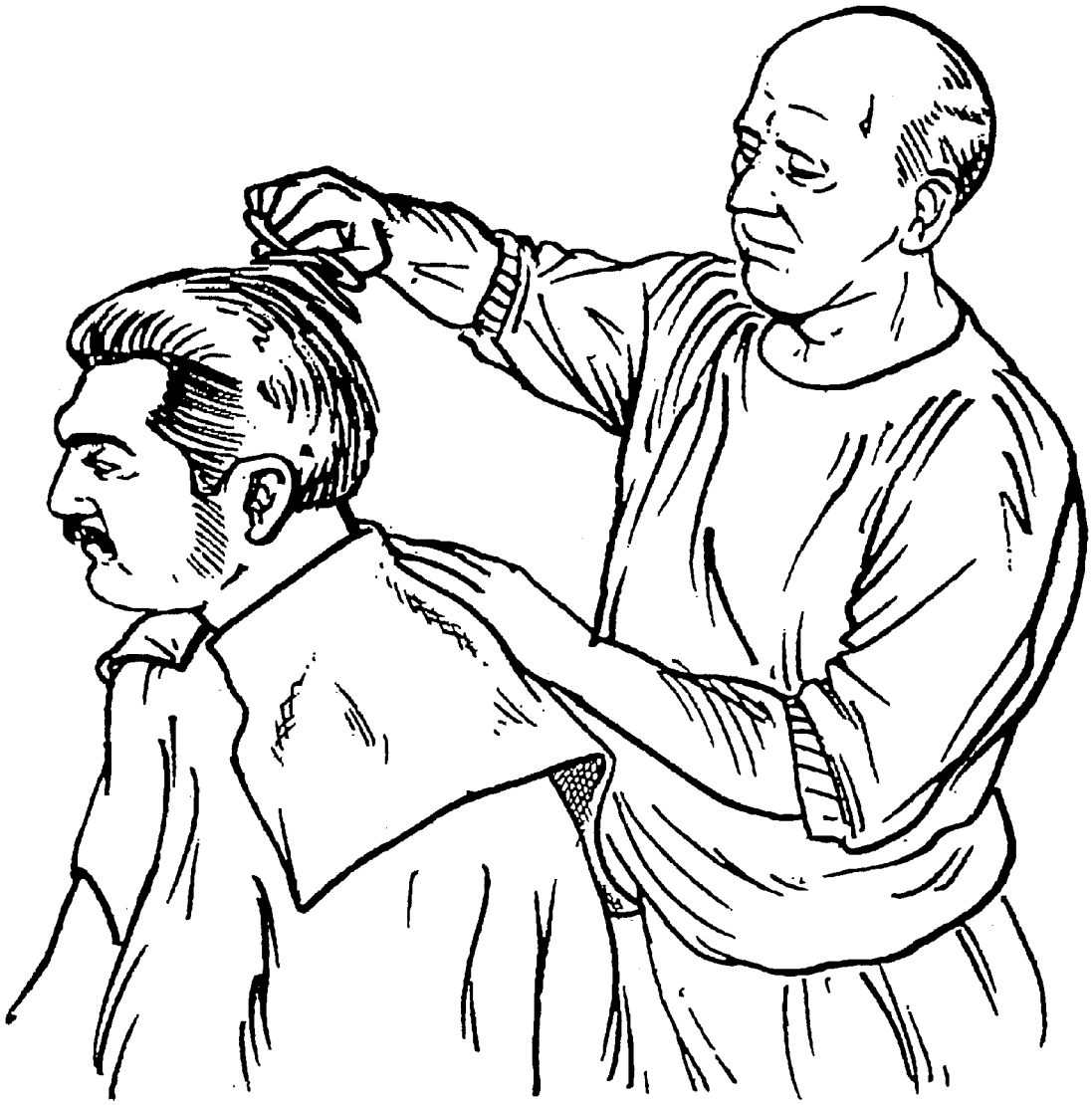
FIG. 2 is a perspective view showing how the towel of the present invention is used.

The use of the towel is illustrated in FIG. 2. While the towel is in use, it is placed over the neck and shoulders of a person, so as to provide coverage and protection for their clothing and skin. In the preferred embodiment, the towel is grasped by its corners. (The corners 31 and 34 are also illustrated in FIG. 1). This allows corners 32 and 33, that are adjacent to slit 30 to fall downward. This results in a substantially V-shaped opening in the upper portion of the towel (not shown in FIG. 2.) The corners 31 and 34 are then wrapped around the user's shoulders. The corners may then be fastened together by using the closure means that was described in reference to FIG. 1 above. The presence of the V-shaped opening allows the towel to be placed around the user's neck and shoulders in a comfortable, but protective, manner. The lower portion of the towel will then lay flat in the desired manner. The towel may also be used as a hair wrap. In that usage, the lower portion of the towel is lifted up and wrapped around the person's head and hair. This is used to hold the person's hair in place, and, if necessary to dry the hair. It is to be understood, however, that the use of the towel as a hair wrap is not meant as a limitation on the present invention.

In the preferred embodiment, the slit 30 is created by simply making a cut of an appropriate length into the towel material. The cut can be created using any well known manufacturing method. In making the slit, the preferred embodiment does not actually remove any material from the towel. It has been found that this manufacturing method is the most efficient and least costly. It will be apparent to those skilled in the art that the slit can be modified from the structure of the preferred embodiment. For example, a V-shaped or U-shaped portion of the towel can be removed to give the desired effect.

Figure 3:
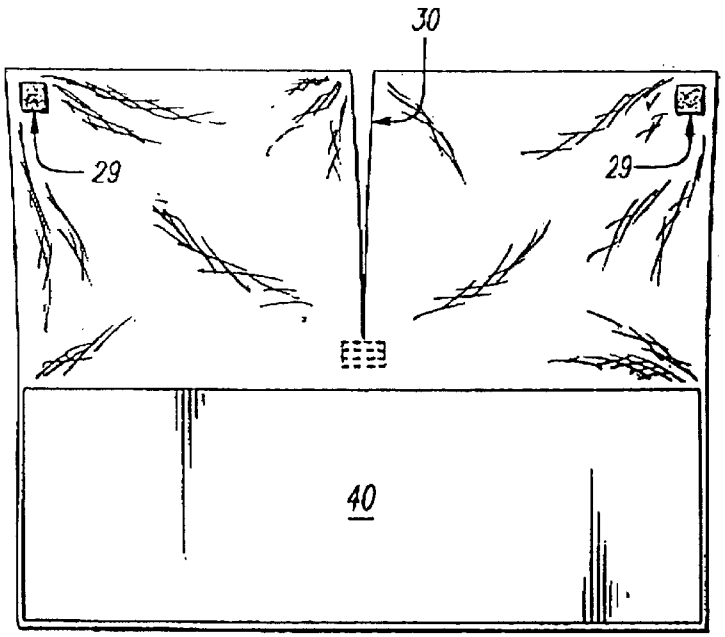
FIG. 3 illustrates an alternative embodiment of the present invention.

Referring next to FIG. 3, an alternative embodiment of the towel is illustrated. In this embodiment, a layer of water-resistant material 40 is affixed to the towel 10. This additional layer of material 40 provides extra protection for the user. For example, the material 40 will prevent water or chemicals from seeping through the towel and onto the customer. The material 40 is affixed to the portion of the towel below the slit 30. When the towel is used, the portion of the towel with the plastic lays flat on the shoulders and back of the user.

The description of the present invention has been made with respect to specific arrangements and constructions of an improved towel. It will be apparent to those skilled in the art that the foregoing description is for illustrative purposes only, and that various changes and modifications can be made to the present invention without departing from the overall spirit and scope of the present invention. The full extent of the present invention is defined and limited only by the following claims.

What is claimed is:

1. A method of using a towel to cover the neck and shoulder portions of a user, the towel including a slit disposed in one edge of the towel, the slit separating first and second portions of the towel, the method comprising the steps of:

holding first and second corners of the towel such that the slit is oriented substantially vertically;

permitting the first and second portions of the towel to fall downward so as to form a top edge of the towel into substantially a V-shape;

wrapping the towel around the neck of the user; and coupling said first and second corners so as to hold the towel securely in place.

2. The method of claim 1 wherein the towel is made from cotton.

3. The method of claim 1 wherein said first and second corners are coupled together by hook and loop material.

4. The method of claim 1 wherein said first and second corners are coupled together by tying.

5. A method of using a substantially rectangular cotton towel to protect clothing and skin of a patron of a hair salon, the towel including a slit disposed in one of the long side edges of the towel and extending partially through said towel, the slit separating first and second portions of the towel, the method comprising the steps of:

grasping a first and a second corner of the towel;

holding the towel in a substantially vertical plane such that the slit is oriented substantially vertically;

permitting the first and second portions of the towel to fall downward so as to form a top edge of the towel into substantially a V-shape, and wherein a vertex of said V-shape is located substantially adjacent to an end of the slit;

engaging said vertex of said V-shape at a neck of said patron;

wrapping the towel around said neck of the patron; and coupling said first and second corners together.

6. The method of claim 5 wherein said coupling step is accomplished using hook and loop material.

7. The method of claim 5 wherein said coupling step is accomplished by tying said first and second corners together.

* * * * *